United States Patent [19]

Bowdish

[11] 4,252,511

[45] Feb. 24, 1981

[54] ROTARY COMPRESSOR OR MOTOR WITH ROTORS HAVING INTERENGAGING BLADES AND RECESSES

[76] Inventor: Meredith E. Bowdish, 4301 Lake Washington Blvd., Kirkland, Wash. 98033

[21] Appl. No.: 13,403

[22] Filed: Feb. 21, 1979

Related U.S. Application Data

[63] Continuation-in-part of Ser. No. 922,865, Jul. 10, 1978, abandoned.

[51] Int. Cl.[3] ..... F04C 18/20; F04C 29/08

[52] U.S. Cl. ..... 418/15; 418/195

[58] Field of Search ..... 418/189, 190, 193, 195, 418/15

[56] References Cited

U.S. PATENT DOCUMENTS

| | | | |
|---|---|---|---|
| 32,372 | 5/1861 | Jones et al. | 418/193 |
| 739,207 | 9/1903 | Nielsen | 418/195 |
| 758,214 | 4/1904 | Nielsen | 418/193 |
| 1,379,653 | 5/1921 | Shoemaker | 418/195 |
| 2,778,317 | 1/1957 | Cockburn | 418/189 |
| 3,176,908 | 4/1965 | Bowdish | 418/193 |
| 3,236,186 | 2/1966 | Wildhaber | 418/195 |
| 3,622,255 | 11/1971 | Lusztig | 418/195 |

FOREIGN PATENT DOCUMENTS

| | | | |
|---|---|---|---|
| 40-29764 | 5/1965 | Japan | 418/195 |

*Primary Examiner*—John J. Vrablik

*Attorney, Agent, or Firm*—Seed, Berry, Vernon & Baynhan

[57] ABSTRACT

The invention concerns an improvement in the rotary devices disclosed in U.S. Pat. Nos. 3,101,700 and 3,176,908 wherein conjointly rotated bladed and recessed rotors with interengaged blades and recesses, alternately converge and diverge with the blades and end faces on the rotors forming cells between pairs of blades and recesses which are subjected to cyclical intake and compression stages on opposite rotational positions where there are ports to supply and exhaust the cells of fluid. Blades and recesses are shaped to define unsymmetrical volumes which conform closely to one another at the downstream portions of these volumes in relation to the direction of rotation. Upstream portions of the blade and recess at an exhaust station are spaced to form a supplementary exhaust passage from the cell to the exhaust port via the recess.

10 Claims, 9 Drawing Figures

ROTARY COMPRESSOR OR MOTOR WITH ROTORS HAVING INTERENGAGING BLADES AND RECESSES

CROSS REFERENCE TO RELATED APPLICATIONS

This application is a continuation-in-part of my earlier application, Ser. No. 922,865, filed July 10, 1978, now abandoned.

BACKGROUND OF THE INVENTION

The present invention relates to an improvement in the rotary devices disclosed in U.S. Pat. Nos. 3,101,700 and 3,176,908 dated Aug. 27, 1963, and Apr. 6, 1965, respectively, and each entitled "Rotary Compressor or Engine". For this reason the foregoing patents are incorporated by reference herein. As is well known in the art and as described in said patents, the device is operable either as a compressor or a motor, depending upon the direction of rotation and direction of flow of compressed gas. Thus, while the detailed description will be with reference to a compressor for brevity, it will be understood that a reversal of operation will result in a motor and the invention is not to be limited to either form of operation.

In each of the patented devices there is a recessed rotor and a male rotor, and the two rotors are mounted in a chamber of a housing to rotate in end-to-end relationship with one another about axes of rotation that intersect one another at an acute angle. Also, the rotors are cooperatively engaged with one another and with the wall of the chamber to define an annular operating well or subchamber which is bounded at its periphery by a portion of the wall. In addition, these prior patents the recesses on the recessed rotor are closed ended at the periphery thereof by a portion of the wall of the chamber, and the recesses and blades of the rotors are cooperatively engaged with one another at angular intervals about the opposing end faces of the rotors to subdivide the subchamber into a series of radially oriented cells which coincide with the intervals between pairs of blades and recesses. The end faces are adapted and interrelated with one another, moreover, so that when the rotors are conjointly rotated, the faces alternately converge and diverge between opposite angular stations at which they diverge to a maximum and converge to coincidence with one another, respectively. This has the effect of subjecting the cells to cyclical intake and compression stages on opposite sides of the subchamber, and there is a pair of ports in the housing, one of which opens into the intake side of the subchamber to supply fluid to the cells, and the other of which opens outwardly from the compression side of the subchamber to exhaust the fluid from the cells.

Each of the patented devices suffers from the fact that while it is desirable to locate at least the exhaust port in proximity to the angular station at which the faces of the rotors converge to coincidence with one another, in order to idealize the compression ratio of the device, this location has the disadvantage that it does not offer much room for the port; and where it is not possible or desirable to use the adjacent end wall of the chamber as an additional or alternative location for the port, then the effective area of the port is often so limited as to severely curtail the operating pressure, compression ratio and/or speed of the device.

One object of the present invention is to remove the limitations which are imposed on the patented devices in this regard. That is, the object of this improvement is to increase the available port area, particularly on the exhaust portion of the cycle. The former devices could only provide exhaust from the narrow downstream end of the cells. This improvement provides for exhaust from both ends of the cell simultaneously, thus doubling the available port area. This only becomes possible if the blade and its recess are designed to form a seal on one side and an open passage to its corresponding cell on the opposite side of the blade. Once this is accomplished it is then possible to provide a port to which the compressed air can exit from the contracting cell, through the passage between the blade and recess and into the exhaust port.

In a device of this kind it is essential to provide sealing between the cells formed by the rotors only during the compression part of the cycle and is not necessary during the intake part of the cycle. It is also essential to understand that the thin terminal edge or tip of the blade forms the seal between the cells. As the walls of the cells converge during compression, the sealing line between cells moves from the outer edge or mouth of the recess to the bottom or closed end of the recess as the blade is moved into the recess.

Another object is to provide a means and technique of this nature whereby any compressed fluid remaining in the recesses when the adjacent cells move beyond the exhaust port can expand to release the residual energy contained therein and can thus be put to use rather than lost. Other objects include the provision of a means and technique of this nature whereby the recesses in the grooved rotor can be supplied with fluid in the region of the intake port so as to counteract a tendency for a vacuum condition to occur in the recesses as the blades retract from the same.

Still a further object is to provide a rotary interdigitating blade and recess type compressor having a greatly reduced headspace.

According to the invention, these objects and advantages are realized by providing channels or ports in the aforesaid portion of the wall of the chamber, which are operatively opposed to cells and to the corresponding end openings of the respective recesses in the periphery of the grooved rotor on one side of the subchamber. The recesses which communicate with the port on that side of the subchamber also communicate through passages between the blades and groove sidewall to supply or exhaust fluid to or from the cells as they are supplied with or exhausted of the fluid, depending on the rotational position within the subchamber on which the recess and port are located.

The channel may communicate with the port through a manifold on the housing interconnected with the port, or the port may communicate with the recess by extending the port in the direction of rotation of the rotors. In either case, the channel or port is preferably angularly elongated about the periphery of the recessed rotor in the direction of rotation, to extend between angular stations which are spaced apart by at least the interval between pairs of blades and recesses. The preferred location of the ports is such that the intake port will terminate at the point where the cells formed between the rotors and separated from each other by the blades contain the maximum amount of air or gas, the starting point of the intake port being where the volume of the cells has been reduced by some predetermined amount and was now increasing. In the drawings the exhaust port starting point is shown in a location that would have provided a fifty percent reduction in the volume or capacity of the aforementioned cells. Preferably the exhaust port will terminate a few degrees short of the line of closest approach between the rotors and the intake port will not start for a few degrees beyond that same line of closest approach. Preferably the intake port is wide open to the blades and the blade recess from the aformentioned starting point to a cut-off point just short of where the contained volume starts to contract.

It can be stated that inasmuch as the blades which separate cell from cell during the compression part of the cycle are sealing on one side of the recess and are open to form a passage to a cell on the opposite side of the blade such that the recess becomes an extension of the cell. As such the pressure in the recess will be the same as the pressure in the cell of which it is an extension. If the seal between cells is always at the top edge of the blade, the exhaust port can be extended or a channel provided to reach the cell extension which is actually the trailing blade recess; and if the channel or extended port does not fall below a line traced by the top edge of the blade, compressed air or gas will exhaust into the port but cannot leak back into the next following cell which will not reach design pressure until it has rotated one more cell length.

The channel or port extension over the recess housing can be described as extending back to the trailing blade recess of a cell (two sequential blades define the extent of a cell) from a point opposite the start of the exhaust port in the blade housing and the width of the channel or a port extension being between a line traced by the closed ends of the blade recesses and a line traced by the terminal sealing edge of the blades. Once a cell has rotated to a position where design pressure has been reached and exhaust has started, there is no further need to maintain a seal between that cell and the cell ahead of it since both are in communication with the exhaust port.

A unique feature of the invention is that the shapes of the respective blades and recesses not only provide a supplemental exhaust passage from between the reducing volume of the opposed end faces of the blade and recess rotors which defines the main compression chamber or cell, but further will reduce headspace between the blade and recess at the maximum compression exhaust station. That is, any gap between the downstream side of a blade and downstream wall of a recess at the point of maximum compression will leave residual incompletely compressed and unexhausted air which serves no useful work. By making the blade and recess unsymmetrical and of conforming volumes this headspace is reduced. Furthermore, the blades and recesses are shaped with constantly widening walls or sides from the respective closed end of a recess and tip of a blade for ease of casting during manufacture.

BRIEF DESCRIPTION OF THE DRAWINGS

These features will be better understood by reference to the accompanying drawings wherein two embodiments of the improved device are illustrated.

In the drawings.

DESCRIPTION OF THE PREFERRED EMBODIMENTS

Figure 1:
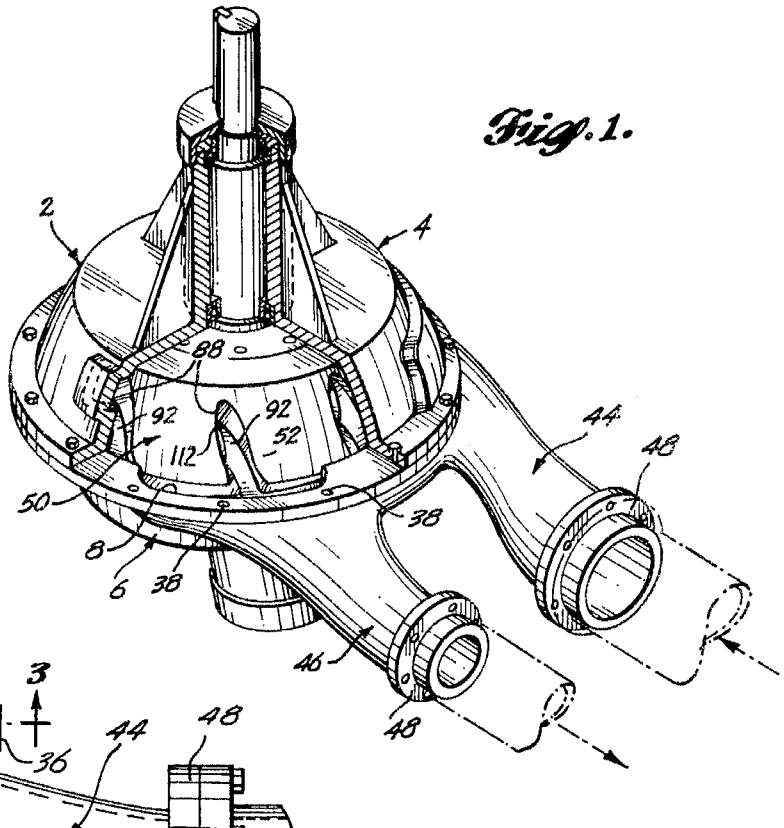
FIG. 1 is a part cutaway perspective view of a compressor employing recesses on both the intake and compression sides of the subchamber, and wherein the recesses communicate with the ports on the respective sides thereof through openings into the subchamber as explained above.

Referring to the drawings, it will be seen that the; housing 2 of the compressor in FIGS. 1–5 comprises a pair of open ended, pan-shaped, cast metal casing members 4 and 6 (FIG. 2) which are inverted to one another and superposed on one another to form a chamber 8 (FIG. 1) therebetween. The peripheral wall 9 (FIG. 2) of the chamber is part spherical in vertical cross section. However, the chamber is otherwise part trapezoidal in vertical section, since the lower casing member 6 is truncated at an acute angle to the axis 14 thereof, and the two members are joined together at that same angle leaving their respective axes 14 and 16 similarly inclined to one another. The respective cross sections of the upper and lower ends of the chamber are also different in that the end wall 10 of the chamber defined by the upper member 4 has a labyrinthian seal thereon, whereas the end wall 12 defined by the lower member 6 is conical in cross section and has a shallow socket 18 in the center thereof at the apex of the cone.

On the outside of the housing, both casing members have boss-like axial extensions 20 and 22 (FIG. 2) formed about the end openings thereof, although the upper extension 20 is somewhat longer than extension 22 on the lower member. Both extensions have reinforcing gussets 24 upstanding therearound, and both extensions have counterbores 26, 28, 30, 32 formed therein to receive bearings as shall be explained. In addition, the casing members have flanges 34 and 36 on the rims thereof, and the flanges are equipped with registering holes 38 that are used in bolting the members together at the joint as shown. On one side of the joint, a pair of ports 40 and 42 (FIGS. 4 and 5) are formed in the rim of the lower member. The ports are spaced apart from one another and are defined by manifolds 44 and 46 (FIGS. 1, 3 and 4) that are cast into the lower member and equipped with collars 48 at the outboard ends thereof for bolting the manifolds to external equipment (not shown).

Figure 2:
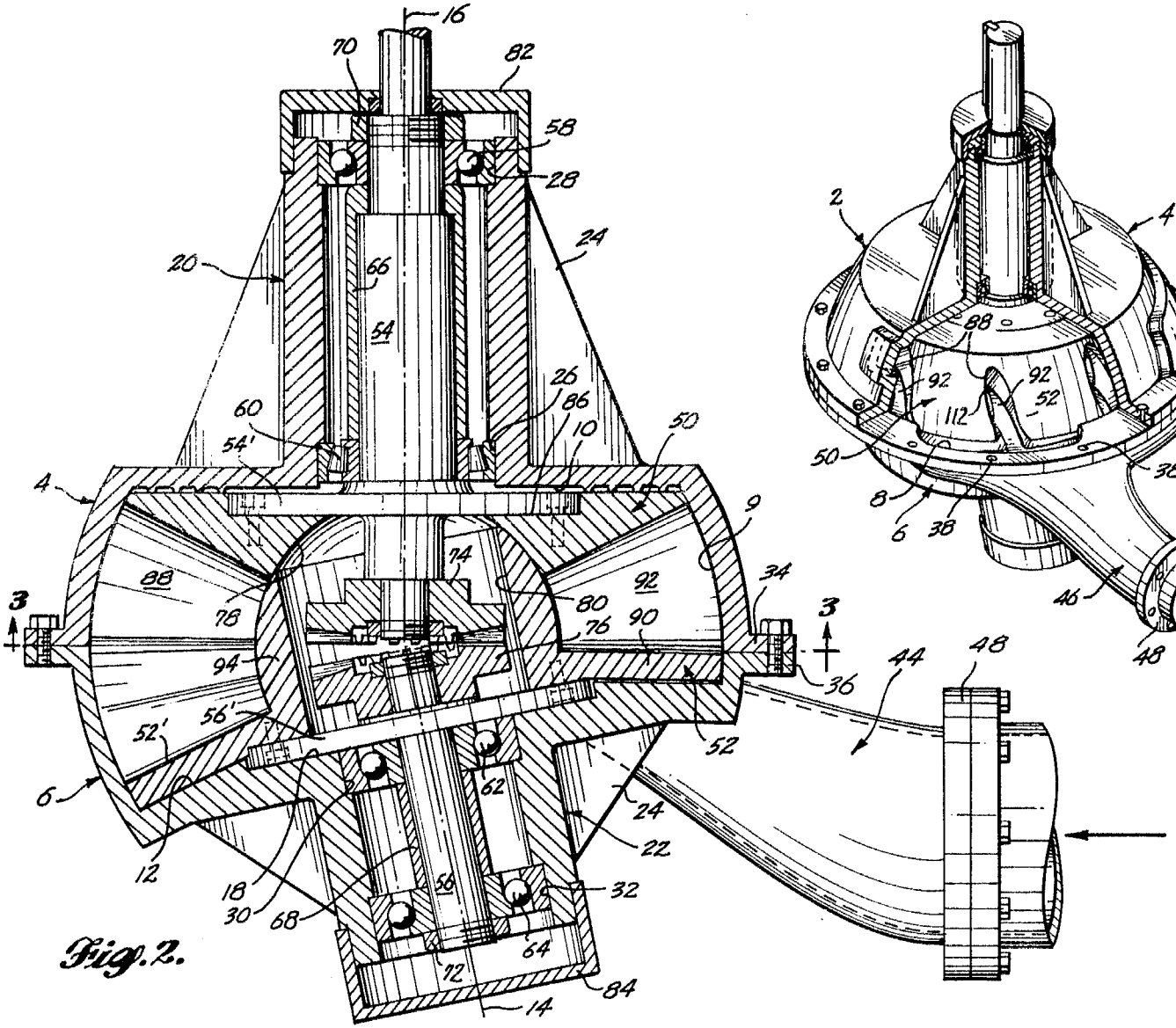
FIG. 2 is a vertical cross section through the compressor coinciding with the angular stations at which the faces of the bladed and recessed rotors diverge to a maximum and converge to coincidence with one another, respectively.

The operating mechanism of the compressor comprises a recessed rotor 50 and a bladed rotor 52 (FIGS. 1 and 2). The rotors are fixed to the relatively inboard ends of a pair of shafts 54 and 56 (FIG. 2) that are rotatably supported in the extensions 20, 22 of the casing members on the intersecting axes 14, 16 of the same. The inboard ends of the shafts are equipped with flanges 54' and 56', and the shafts are rotatably journalled in pairs of bearings 58, 60, 62 and 64 which are seated in the counterbores 26, 28, 30, 32 of the extensions and clamped between the respective flanges of the shafts, a pair of intermediate sleeves 66 and 68 thereon, and a pair of nuts 70 and 72 which are screwed onto the outboard ends of the shafts. The rotors have hollow centers and are circumposed about the relatively inboard ends of the shafts and cap screwed to the relatively inboard faces of the flanges 54' and 56'. The inboard ends of the shafts also have complemental bevel gears 74 and 76 thereon, and the gears are interengaged with one another in the hollows 78 and 80 of the rotors. The rotors, meanwhile, are cooperatively engaged in end-to-end relationship with one another as shown, so as to be conjointly rotatable when one of the shafts is driven about its axis; and toward this end, the shaft 54 of the female rotor 50 is extended outwardly beyond the boss-like extension 20 for the same, so that it can be driven externally of the housing. The other shaft 56 is stubbed off within the extension for it, and caps 82 and 83 are applied to the ends of the extensions to cover the same, the cap 82 being apertured to pass the shaft 54 therethrough as shown.

Figure 5:
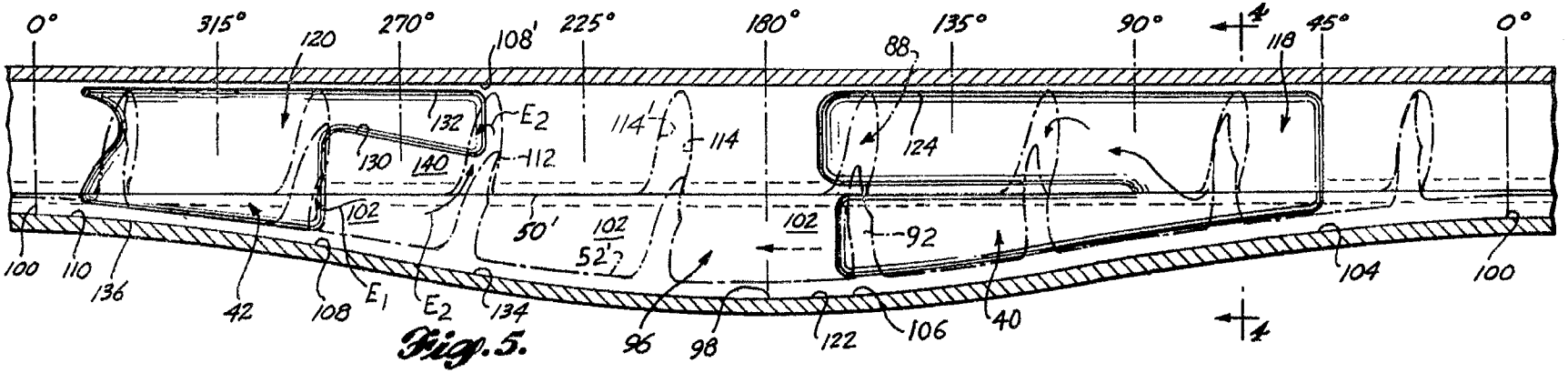
FIG. 5 is a schematic representation of the operating mechanism in the compressor as the rotors traverse a full rotational cycle therein.
Figure 4:
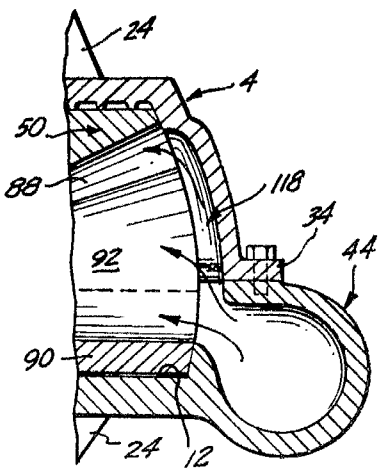
FIG. 4 is a fragmentary cross sectional view along the line 4—4 of FIG. 5.
Figure 3:
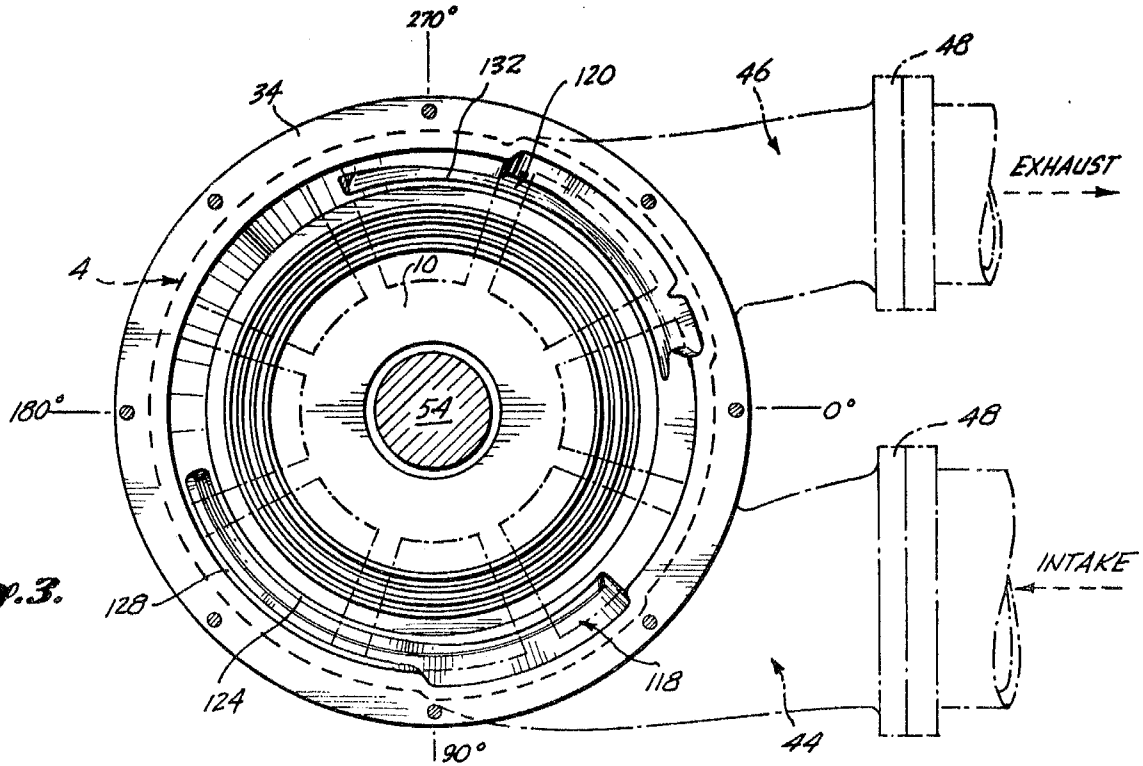
FIG. 3 is a part schematic cross sectional view along the line 3—3 of FIG. 2.

The recessed rotor 50 is disc-like in shape (FIGS. 1–3) and has a socket 86 (FIG. 2) in the top face thereof to accommodate the flange 54', and a series of open-ended, radially extending recesses 88 in the bottom or operative face 50' thereof. The bladed male rotor 52 is hub-like in shape and has a part conical base 90 on the bottom thereof, and a series of radially extending blades 92 on the top or operative face 52' thereof, which extend between the hub 94 and the outer peripheral edge of the base 90. The blades 92 and recesses 88 of the respective rotors are equal in number and circumferentially spaced about the axes 14, 16 of the rotors, and are adapted so that they cooperatively engage with one another at angular intervals about the intersection of the axes in the manner of the patented devices. Also, the conical angle of the face 52' corresponds to the acute angle between the axes at the intersection thereof, so that when the rotors are conjointly rotated, the operative faces 50' and 52' of the rotors alternately converge and diverge between opposite angular stations 98 and 100 (FIG. 5) at which they diverge to a maximum and converge to coincidence with one another, respectively, as is schematically represented in FIG. 5. The station 98 can be seen at 180° in the figure. The station 100 is schematically represented at both ends of the view, i.e. at 0°. Meanwhile, the rotors form sliding seals with one another and with the peripheral wall 9 and end walls 10, 12 and 18 (FIG. 2) of the housing, so that the faces 50', 52' of the rotors form an annular subchamber 96 (FIG. 5) therebetween which is bounded at its periphery by the wall 9. Note in this connection that the hollow 78 of the recessed rotor has a part spherical configuration, and the hub 94 of the bladed rotor has a complemental dome-like configuration to mate with the hollow as shown and to form a sliding seal therewith when the rotors are conjointly rotated. Note too that the flange 56' of the shaft 56 is slidably seated in the socket 18 of the end wall 12 of the chamber, and that the base 90 of the bladed rotor mates with the wall 12 itself so that a sliding seal is also formed between the end wall 12 and the bladed rotor 52. And lastly, note that the periphery of the female rotor is relatively rotatably engaged with the upper portion of the wall 9 of the chamber so that a sliding seal is also formed at this point in the assembly.

As in the patented devices, the recesses 88 and blades 92 not only cooperatively engage with one another to permit the rotors to conjointly rotate with one another as described, but they also operate to subdivide the subchamber 96 into a series of radially oriented cells 102 (FIG. 5) which coincide with the spaces or intervals between pairs of blades and recesses. Moreover, as the faces 50', 52' of the rotors diverge and converge, the cells are subjected to cyclical intake and compression stages on the opposite rotational stations of the subchamber defined by the aforesaid angular stations 98 and 100 thereof. The ports 40 and 42 are interconnected with the subchamber so that the port 40 opens into the intake side of the subchamber at an early point in the intake stage, and the port 42 opens outwardly from the compression side of the subchamber near the end of the compression stage. See FIGS. 2, 3 and 5 in particular. Note that the mouth of the intake port 40 commences in the direction of rotation at a first angular station 104 on the intake side of the subchamber; and that as each cell rotates opposite the mouth of the port, it intakes fluid between this station and a second angular station 106 therebeyond where the mouth of the port terminates. The mouth of the exhaust port 42 commences in the direction of rotation at a third angular station 108 and at station 108' of the port extension on the compression side of the subchamber; and as each cell rotates opposite the mouth of the exhaust port, the compressed fluid is exhausted from both ends of the cell; i.e. from between faces 50', 52' at 108 as shown by arrow $E_1$ and via the blade recess at 108' as shown by arrow $E_2$ until the mouth of the port terminates at a fourth angular station 110.

Figure 8B:
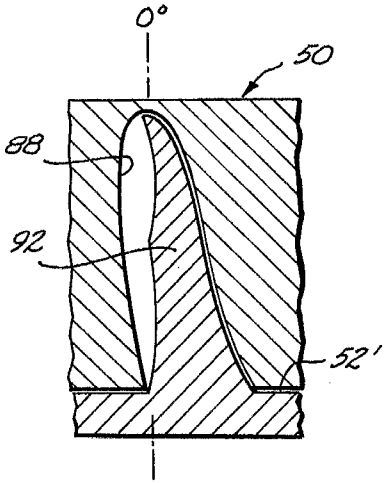
FIGS. 8A and 8B are schematic drawings showing a blade in a recess approaching and at top dead center, respectfully.
Figure 8A:
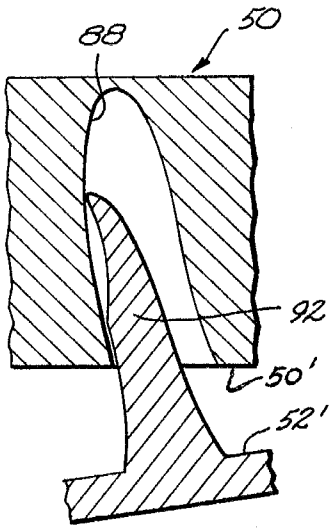

In order to maintain the integrity of the individual cells throughout this process, sliding seals are formed between corresponding recesses and blades during the compression phase of the process. Unlike the patented devices, the blades and the blade recesses are unsymmetrical (FIGS. 8A and 8B). That is, the volume of each recess 88 is unsymmetrical to a plane (FIG. 8B) through the closed end of the recess which is perpendicular to the surrounding face 50'. In addition the sidewalls of the recess diverge constantly from the closed end to the open mouth of each recess at the surrounding face 50'. Similarly the blade 92 has a sealing tip 112 which engages a sidewall of a recess for sealing against air leakage to the next adjacent cell or compression chamber at the maximum compression station. The blade has sidewalls that diverge inwardly to a root position adjacent the face 52'. The sidewalls also define a solid volume unsymmetrical about a plane through the tip of the blade, which is perpendicular to face 51', as is best shown in FIGS. 8A and 8B. The greater volume on the recess and blade sides of such planes is on the back or downstream side of the planes in relation to the rotational direction of movement of the rotors. The unsymmetrical shapes provide a supplemental exhaust passage to port 120' along arrow $E_2$ but also reduce the downstream headspace between the blade and recess to a minimum (see FIG. 8B). The divergence in the sidewalls of the recess and blade also assist in casting these parts.

The sealing tip 112 (FIGS. 1 and 5) is a raised sealing strip at the terminal end on one side of the blade which engages a concavely shaped wall of the recess 114 which closely coincides with the arc described by the blade sealing strip as it is moved into the recess. The opposing wall of the blade recess 114' and the mating side of the blade are spaced well apart during all of the compression phase of the cycle to provide an ample exit passage from the cell for the compressed air at exhaust as shown by arrows $E_2$. It should be pointed out that port extensions or channels 118 and 120 are not necessarily shallow as shown on the drawings but may be as deep as is required to handle the required flow of gas.

The channel 120 (FIG. 5) in the upper portion of the peripheral wall 9 (FIG. 2) on the compression side of the subchamber coincides with the line traced by the sealing strip 112 of the blades in the direction of rotation. The edge 132 of the channel 120 coincides with the line traced by the closed ends of the recesses 88 in the recessed rotor; but the channel 120 is angularly elongated between an angular station 134 which is disposed one cell interval ahead of the station 108 at which the mouth of the exhaust port commences in the direction of rotation, and an angular station 136 which is spaced apart from it opposite the port but short of the angular station 110 at which the mouth of the port terminates.

Figure 7:
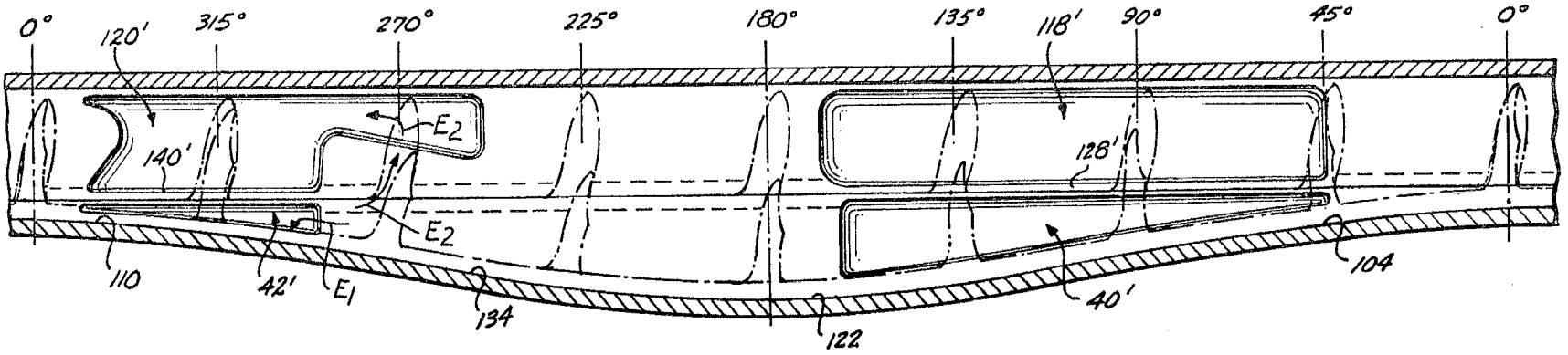
FIG. 7 is a schematic representation of the operating mechanism in the latter compressor of FIG. 6, similar to the representation shown in FIG. 5 but with the rotors advanced $22\frac{1}{2}°$.
Figure 6:
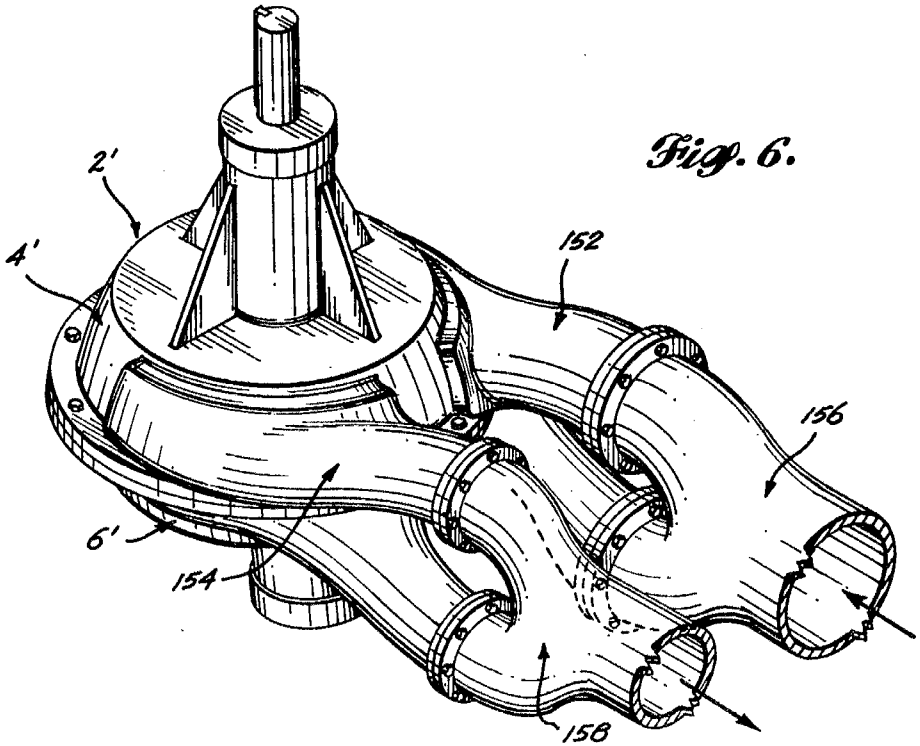
FIG. 6 is a perspective view of another compressor employing channels on both sides of the housing, wherein the recesses communicate with the respective ports through channels on the housing interconnected with the ports as explained above.

In the embodiment of FIGS. 6 and 7, the channels 118' and 120' in the upper portion of the peripheral wall 9 of the chamber open into the intake and exhaust ports through a set of secondary manifolds 152 and 154 (FIG. 7). The manifolds are cast into the upper casing member 4' and extend peripherally outwardly from the housing 2' to join with the manifolds 44 and 46 on the casing member 6', at Y-junctions 156 and 158 therein. Of course, the lands 128' and 140' between the recesses and the section line 3—3 are continuous and uninterrupted.

I claim:

1. In a rotary compressor or expander device of the type wherein a recessed first rotor and a bladed second rotor having respectively equal numbers of circumferentially spaced, interengaging recesses and blades are mounted in a chamber of a housing to rotate in end-to-end relationship with one another about axes of rotation that intersect one another at an acute angle, the rotors have end faces surrounding the respective recesses and blades and the blades divide the resulting space between the faces of the rotors into a series of cells which alternately contract and expand as the rotors are conjointly rotated, said housing have a low-pressure port and a high-pressure port; the improvement wherein said high-pressure port having main and supplemental portions, the seal between cells is confined to rearward sides of the blade and the blade recess in the direction of rotor rotation for compression, while the sides of the blade and recess define a passage which remains in open communication with its respective cell and with the supplemental portion of said high-pressure port overlying only the blade recesses upstream of the main portion of the high-pressure port in the compression direction of rotor rotation to allow fluid to exhaust from the trailing end of the cell through the respective blade recess and supplemental portion of the high-pressure port simultaneously with exhaust through the main portion of the high-pressure port from the leading end of the cell which lies between the converging faces of the rotor housing.

2. The rotary compressor or expander device according to claim 1, wherein the main portion of the high pressure port overlies the cells between opposed end faces of the rotors, and the beginning of the supplemental portion of the high pressure port opens to the advancing blade recess at the same instant that the main high pressure port opens to the remainder of the cell.

3. The rotary compressor or expander device according to claim 1, wherein the supplemental portion of the high pressure port lies above the line traced by the upper edge of the blades from the point in which the recess first communicates with the supplemental portion to a second point spaced from said first point a distance equal to the distance between two blades.

4. The rotary compressor or expander device according to claim 1, wherein the supplemental portion of the high pressure port is extended opposite to the direction of rotor rotation beyond the starting point of the main portion of the high pressure port, both portions of said high pressure ports being joined together from the starting point of the port to a second point which defines a length approximately equal and coincident with the maximum contraction zone of the cells.

5. The rotary compressor or expander device of claim 1, said low-pressure port having a main portion and a supplemental portion, the main portion overlying the cells between the opposed end faces of the rotors and the supplemental portion overlying the recesses.

6. The device of claim 1, each said blade being unsymmetrical in solid volume about a plane perpendicular to the face of said bladed second rotor and passing through the tip of the blade, each said recess being unsymmetrical in volume about a plane perpendicular to the face of said recessed first rotor and passing through the closed end of the recess, said larger portions of said unsymmetrical volumes of said blade and said recess lying downstream of said planes in the direction of movement of said rotors as a compressor, and said forward sides of each said blade and recess are matched in shape and closely confronting each other while at the point of rotor rotation in which the blade is furthest inserted into the recess for minimizing headspace between the forward sides of blade and recess during compression.

7. The rotary compressor or expander device of claim 2, said low-pressure port having a main portion and a supplemental portion, the main portion overlying the cells between the opposed end faces of the rotors and the supplemental portion overlying the recesses.

8. In a rotary compressor or expander device of a type wherein the blades of a bladed rotor, having an end face between the blades, alternately penetrate into and retract from the recesses of a recessed rotor, also having an end face between the recesses, when the rotors are conjointly rotated in a chamber, said rotors rotating about axes that intersect one another at an acute angle, the chamber having a circumferential wall which defines a sliding seal with the periphery of the rotors, the feature of the recesses of the recessed rotor having end openings to said circumferential wall, and there being a high-pressure port in said circumferential wall having a supplemental portion which is operatively overlying and communicating only with the end openings of the recesses and having a main portion overlying the space between said opposed faces, said blades and recesses each having respective forward and rearward sides in the direction of rotor rotation as a compressor, and including passage means between the forward sides of each recess and blade for transferring fluid from said space between said rotor end faces, through said passage means, thence through said end opening of said recess and out said supplemental high-pressure portion when the blade penetrates into the recess, and means for sealing the rearward side of the blades and recesses when rotated as a compressor to preclude passage of fluid from between said rotor end faces.

9. In a rotary air compressor or expander device of the type having a first rotor including a plurality of circumferentially spaced recesses and a second rotor having a plurality of circumferentially spaced blades of equal number to said recesses and which can selectively interdigitate within said recesses, said rotors mounted for rotation about axes which intersect one another at an acute angle wherein said blades become fully inserted within said recesses at a high-pressure station, each recess having a closed end and opposed side walls diverging outwardly to an open mouth, said first rotor having a smooth face surrounding the open mouths of said recesses between adjacent recesses, and the volume of said recesses being unsymmetrical about a plane through said closed end perpendicular to said smooth face, said blades each having a sealing tip and opposed sides diverging from said tip to an enlarged root, and said sealing tip being engaged with a wall of said recess at said high-pressure station for isolating one recess from the next adjacent recess, a smooth face on the bladed rotor surrounding the roots of the blades between adjacent blades, said blade having a volume unsymmetrical about a plane through said tip and perpendicular to the face of the bladed second rotor, said forward side of a blade and forward confronting wall of a recess in the direction of the rotor rotation as a compressor being of matched and conforming shapes and closely confronting one another while at the point of rotor rotation in which the blade is furthest inserted in its respective recess, the unsymmetrical shape of said recesses and blades and the matched shapes of the confronting forward blade side and recess wall reducing headspace between a blade and recess at the high-pressure station, means enclosing said blades, recesses and respective rotor faces for forming chambers thereof, means for providing air to pass at said low-pressure station and means for removing air at said high-pressure station when compressing, and means for coupling said rotors to a driving source for rotating the rotors.

10. The rotary device of claim 9, said means for removing air when a compressor including a high-pressure primary port portion overlying said chamber between the faces of the first and second rotors, and including a high-pressure supplementary port portion overlying said recess at said high-pressure station rearward of said primary portion in the direction of rotor rotating for compression, the forward side of said blade and the forward wall of said recess in relation to rotational movement of said receses and blades being spaced from one another slightly to provide a passage for compressed air during compression from between said opposed faces of said first and second rotors to said supplementary high-pressure port portion via said recess to assist in exhausting said compressed air when rotated as a compressor.

* * * * *